United States Patent [19]

Takeuchi

[11] 4,449,279

[45] May 22, 1984

[54] BAG SYSTEM FOR TRANSPORTATION OF BULK LIQUIDS

[75] Inventor: Seiji Takeuchi, Burlington, Canada

[73] Assignee: Don Fell Limited and Lawrence Fell Limited, Hamilton, Canada

[21] Appl. No.: 487,056

[22] Filed: Apr. 21, 1983

Related U.S. Application Data

[62] Division of Ser. No. 235,836, Feb. 19, 1981.

[30] Foreign Application Priority Data

Jan. 7, 1981 [CA] Canada ..... 368021

[51] Int. Cl.[3] ..... B23P 7/00

[52] U.S. Cl. ..... 29/401.1; 383/4

[58] Field of Search ..... 29/401.1, 402.01–402.09, 29/402.11, 402.12, 402.14, 402.15, 402.17, 403.1, 403.3; 383/4; 150/3

[56] References Cited

U.S. PATENT DOCUMENTS 3,068,561 12/1962 Jones ..... 29/401.1

*Primary Examiner*—Mark Rosenbaum

*Assistant Examiner*—V. K. Rising

[57] ABSTRACT

A bag of tough, flexible material, sealed to be liquid tight except for filling and emptying access ports, is designed for mounting in a standard transportation container. The bag is then filled with a bulk liquid and transported in the container to a desired destination where it is again emptied. To avoid the transportation cost of returning many such bags to the point of origin, while nevertheless not simply discarding them, the present invention provides the third alternative of so constructing each bag that, after use, it can be cut to become suitable for use as a tarpaulin. For this purpose the bag is constructed of a central, generally cylindrical, elongated portion extending at each end into a curved end portion. Tie down devices, i.e. flaps each containing a rigid eye for receiving a tie down rope, are arranged in a pair of circumferential rows extending around the periphery of the central portion near each end portion and in a further pair of adjacent parallel rows extending longitudinally along the central portion between the circumferential rows. By cutting the used bag longitudinally between the latter pair of rows and peripherally outwardly of the circumferential rows, the central portion is transformed into a rectangular sheet with the tie down devices disposed around its periphery.

2 Claims, 17 Drawing Figures

BAG SYSTEM FOR TRANSPORTATION OF BULK LIQUIDS

This application is a division, of application Ser. No. 235,836, filed Feb. 19, 1981.

FIELD OF THE INVENTION

This invention relates to a flexible bag system for the transportation of bulk liquids and to the use thereof. Such a system is particularly suitable for the transportation of non-hazardous liquids in bulk quantities, such as chemical liquid products and detergents, as well as heavy liquids, such as latex, palm oil, molasses and even some foodstuffs, although in the case of products for human consumption special hygiene conditions may dictate the need for additional precautions beyond the concern of the present invention.

Theoretically, such a bag system can even be used for the transportation of flowable solids, although these often present caking and similar problems that may render them unsuitable for transportation in such a system. Nevertheless, it is to be understood that, in referring to the transportation of "liquid" in bulk, the present specification is not intended to exclude a flowable solid that performs essentially as a liquid and is suitable for shipping by a flexible bag system.

BACKGROUND OF THE INVENTION

It is already known to use bag systems for the transportation of bulk liquids. Such bags can be mounted in standard, dry, van type containers or the like, such containers being suitable for piggy-back transfer between road vehicles, rail vehicles or water borne vessels.

Flexible bags of tough sheet material have been developed for this specific purpose and are typically mounted in a standard container and secured therein by a harness of strapping. The bag is inserted into the container empty, filled, then transported in the container to the desired destination and there emptied. The filling and emptying processes are carried out by suitable pumping devices. In the past the empty bags have been designed to be returned to the point of origin for reuse. However, increasing transportation cost for returning the bags has often resulted in their being simply discarded.

SUMMARY OF THE INVENTION

The principal object of the present invention is to provide a third alternative, namely one that enables useful utilization of the bags, while at the same time avoiding the cost of their return shipment.

To this end the invention can be defined as a bag of tough flexible sheet material for mounting in a standard freight container to transport a liquid in bulk, said bag being liquid tight except for controlled access means for filling and emptying the bag, including a series of spacedapart, tie down means secured to said material and so arranged thereon that after use the bag can be cut to provide a sheet with the tie down means substantially uniformly disposed around the periphery thereof in a manner suitable for use as a tarpaulin.

Other features of embodiments of the invention are disclosed below in connection with the accompanying drawings which illustrate such embodiments by way of example. It is to be understood that these embodiments do not limit the broad scope of the present invention which is defined in the appended claims.

DESCRIPTION OF PREFERRED EMBODIMENTS

Figure 1:
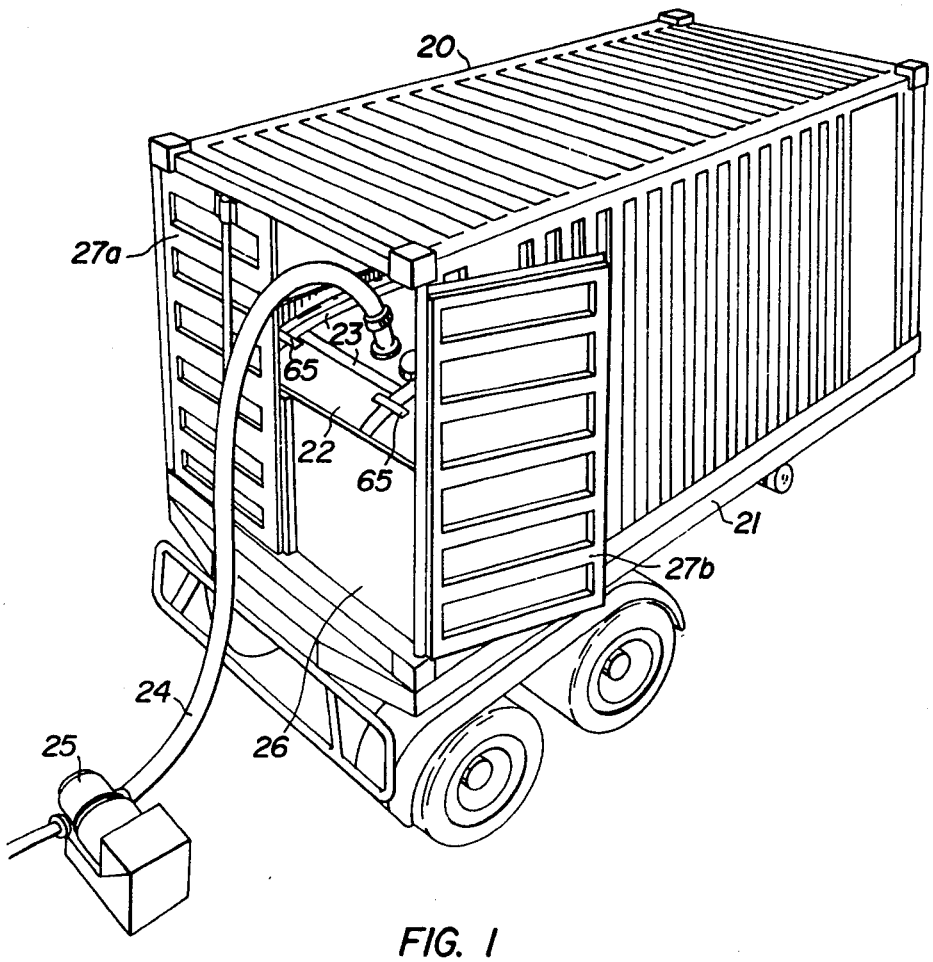
FIG. 1 (PRIOR ART)
FIG. 1 is a rear perspective view of a container with a bag for transporting bulk liquid mounted therein, this view representing the prior art.

FIG. 1 shows a container 20 mounted on a trailer chassis 21 and serving to support a flexible bag 22 that is kept in place by harness straps 23 while being filled through a hose 24 by means of a pump 25. Safety regulations require that, during filling, the rear of the container 20 must be at least partially closed off by a transverse bulkhead 26 which in turn is firmly held in place by one of the doors **27*a* of the container. The other door 27*b*** will be closed during transit but can be open during loading and unloading to provide access.

Figure 2:
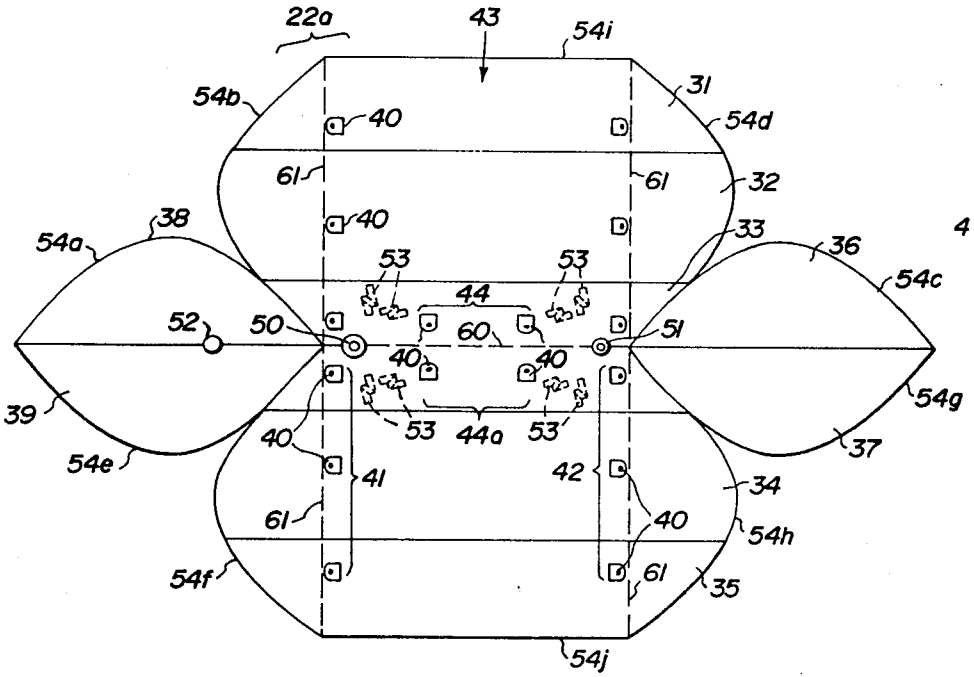
FIG. 2 is a plan view of a blank for making an improved bag according to an embodiment of the present invention.

FIG. 2 shows a blank **22*a* for use in making a flexible bag 22*b* according to an embodiment of the present invention and shown constructed in FIG. 5, such bag being for use in the general manner illustrated in FIG. 1**, but with the additional features that will be explained.

The bag **22*b*** will be made of a tough, flexible abrasion resistant, sheet material. For example, the bag may be made of a material the base of which is a polyester resin or woven nylon, preferably coated on both sides with PVC. Alternative base materials are cotton and woven glass and alternative coatings are Teflon and Hypalon (a by-product of Neoprene). Obviously, it is important that the coatings be resistant to any chemical attack by the bulk product to be transported. Materials of this type are well known for the purpose and the present invention is not concerned with the choice of specific materials.

However, a useful by-product of non-returnable feature of the present invention is that, for many applications, it becomes possible to use a lighter weight of sheet material than has hitherto been the practice. In the past, it has been usual to construct such bags for the transportation of bulk liquids from sheet material having a weight of around 40 ounces per square yard. This weight of material has been found necessary in order to ensure satisfactory performance with repeated uses of the bag. It is a feature of the present invention that the bag will not be returned to the point of origin but will be utilized in a different way at the destination location. It has been found that single use of the bag enables a lighter weight material to be safely used, even down to a weight of 16 ounces per square yard, although this may require to be increased to somewhere in the range of about 30 ounces per square yard if the abrasive content of the liquid to be transported is relatively high. Nevertheless, the weight for bags that are not designed for reuse can generally be lower than the typical 40 ounces per square yard of returnable bags, and this consideration is important from the viewpoint of the overall economics of such an operation.

The blank 22*a* shown in FIG. 2 is constructed of a series of strips 31 through 39 seamed together in the manner that will be described below. Secured to the surface of the blank 22*a*, as seen in FIG. 2, is a series of tie down devices 40 arranged in a first pair of rows 41 and 42 which, when the bag is constructed (FIG. 5), extend circumferentially around the central portion 43 of the bag near the ends of such central portion. In addition, there is a second pair of parallel, adjacent rows 44 and 44*a* extending longitudinally along the central portion between the circumferential rows 41, 42.

Also formed in the blank 22*a* are a filling and emptying valve 50, a vent 51 and a drain 52, details of which will later be described.

Also formed on the underside of the blank 22*a* as seen in FIG. 2 are loops 53, details of which will also be provided below.

Figure 5:
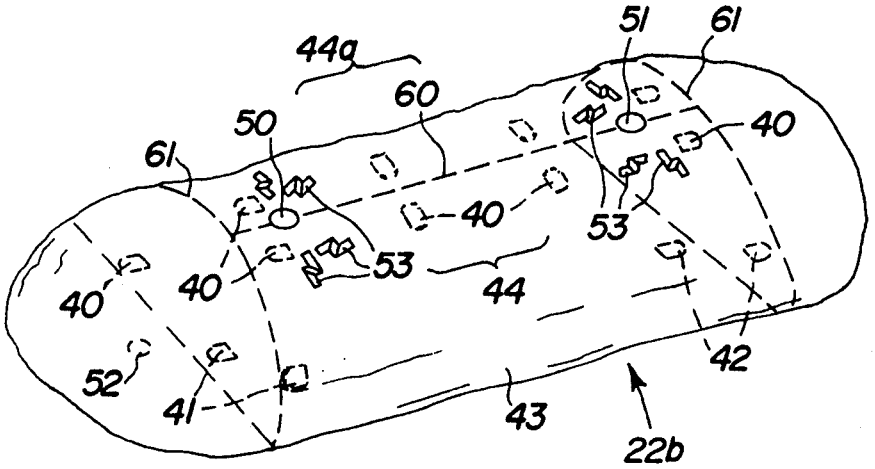
FIG. 5 is a perspective view of a bag constructed from the blank of FIG. 2.

To construct the bag, the edges 54*a* and 54*b* are seamed together and in a similar manner edges 54*c*, 54*d*; 54*e*, 54*f*; 54*g*, 54*h*; and 54*i* and 54*j* are connected together to form a closed bag which after inversion is as seen in FIG. 5.

Figure 7:
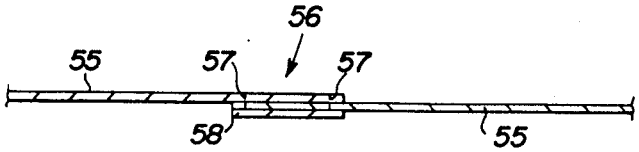
FIG. 7 is a fragmentary sectional view of a seam formed in the bag.

The manner in which these edges are seamed together is demonstrated in FIG. 7, the sheet material 55 of the bag being overlapped in the area 56 and joined together by lines of stitching 57. A narrow strip 58 of the same material is then placed over the lines of stitching 57 to cover the holes and the whole assembly is subjected to a heat sealing process whereby the seam is made liquid tight.

After use, the bag 22*b* is slit opened along a slit line 60 between the rows 44 and 44*a* of tie down devices 40, and is also cut along circumferential lines 61 to separate the central portion 43 from the end portions. The result is the article 62 shown in FIG. 6, which now has the series of tie down devices 40 arranged substantially uniformly around its periphery. The article 62 can be used as a tarpaulin or like covering device, but can of course be used for any other purpose in which a flat sheet with tie down devices is useful.

Figure 3:
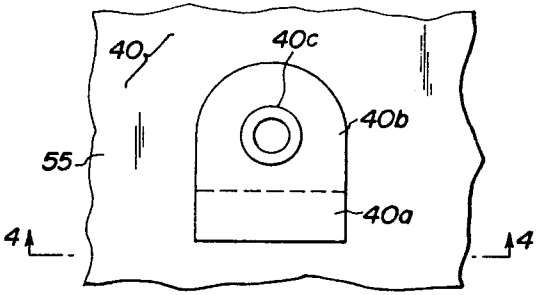
FIG. 3 is a fragmentary view showing one of a series of tie down devices used in this bag.
Figure 4:
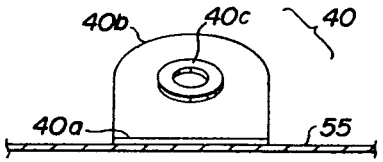
FIG. 4 is a view on 4—4 in FIG. 3.
Figure 6:
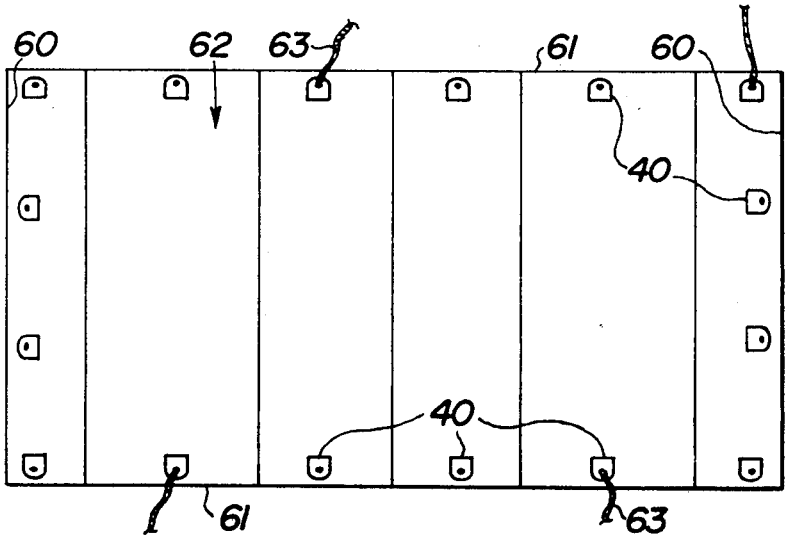
FIG. 6 is a plan view of a tarpaulin cut from the bag of FIG. 5.

FIGS. 3 and 4 provide details of each tie down device 40 which consists basically of a first part 40*a* heat sealed to the sheet material 55 and a second part 40*b* which acts as a flap and is formed with an eye 40*c* of a suitable material such as a tough, relatively rigid, durable plastic. As shown in FIG. 6, each tie down device 40 thus forms a basis for connection of a tie down rope 63.

As already mentioned, secured, also by heat sealing, to the underside of the blank 22*a* as seen in FIG. 2, so as to be on the outside of the bag 22*b* when it has been formed, are a series of eight loops 53 which serve to receive and retain straps that function as the harness 23 for retaining the bag in place in the container.

Figure 17:
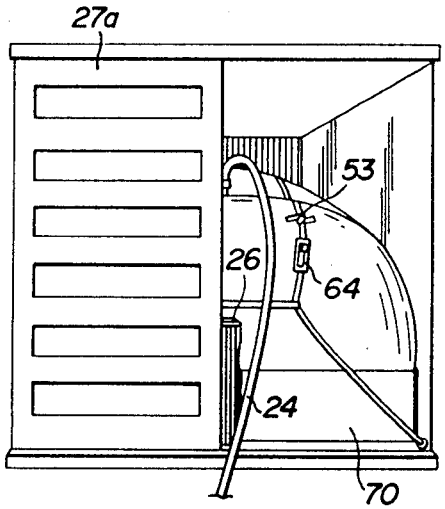
FIG. 17 is a further view similar to FIG. 16 showing the filling operation completed.

In order to allow for appropriate tightening and loosening of the harness straps, these need to be provided with buckles, typical examples of which are best seen at 64 in FIG. 17.

Prior bag constructions have used simple loops for retaining these straps, as shown at 65 in FIG. 1, but difficulty has been experienced with threading the best type of buckles through such loops. It is desirable that the buckles should be strong and reliable, and this requires them to be substantially larger than the straps that they interconnect. The prior form of simple loops 65 has, however, tended to mitigate against the use of the better buckles, because of their relatively large transverse dimensions compared to that of the straps and the consequent difficulty of threading them through a loop that will at the same time perform a snug retaining function for a strap itself, i.e. restrain transverse movement of such strap.

Figure 8:
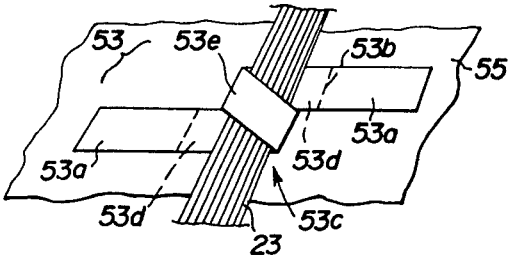
FIG. 8 is a view of a loop arrangement for use with the bag.
Figure 9:
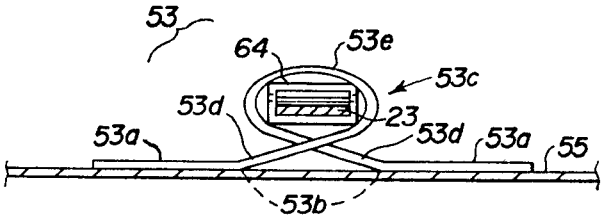
FIG. 9 is a view showing the manner in which the loop of FIG. 8 can be utilized.

The present apparatus employs a novel form of loop 53 shown in FIGS. 8 and 9 secured to the material 55 of the bag by heat sealing in the usual way. The loop 53 consists of a pair of end portions 53*a* which are parallel to but laterally displaced from each other. These end portions 53*a* are sealed to the material 55 up to the lines 54*b*, leaving a central portion 53*c* of the loop free from engagement with the sheet 55. This central portion 53*c* of the loop thus consists of a pair of parallel portions 53*d* and an interconnecting oblique portion 53*e*. With the loop lying comparatively flat against the sheet 55 and a strap 23 threaded through it, as shown in FIG. 8, there is comparatively little tranverse play, the strap thus being constrained against any significant sideways movement. However, when it is desired to open up the loop to thread a buckle 64 through it, the arrangement permits the loop to expand significantly and allow a buckle 64 with relatively large transverse dimensions to pass through, as demonstrated in FIG. 9.

Figure 10:
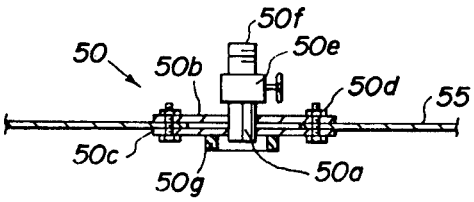
FIG. 10 is a sectional view of a filling and emptying valve for incorporation in the bag.

As previously mentioned, the bag is provided with a filling and emptying valve 50 which is shown in detail in FIG. 10 and consists basically of a pipe 50*a* secured to a pair of plates 50*b* and 50*c* which are clamped by bolt and nut assemblies 50*d* to surround a hole in the sheet 55 in a liquid type manner. The pipe 50*a* is furnished with a valve 50*e* and a screw threaded end 50*f* for connection to an external hose, such as the hose 24 shown in FIG. 1. On the inside of the bag, the plate 50*c* is provided with an inwardly projecting ring 50*g* that projects beyond the end of the pipe 50*a* whereby to ensure that the latter can never be occluded by another part of the bag when the pressure therein is below atmospheric.

Figure 11:
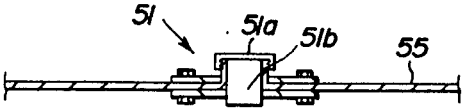
FIG. 11 is a sectional view of a vent for incorporation in the bag.

As also mentioned above, the bag is further provided with a vent 51 shown in FIG. 11 as consisting of a similar arrangement of clamped plates, but without a valve. Instead, it has a simple cap 51*a* that threads onto the pipe 51*b*. The drain 52 can be similar in construction to the vent 51. If found necessary, the vent 51 or the drain 52 can be formed with a ring such as the ring 50*g* to ensure that the outlet can never be occluded by another part of the bag.

Figure 12:
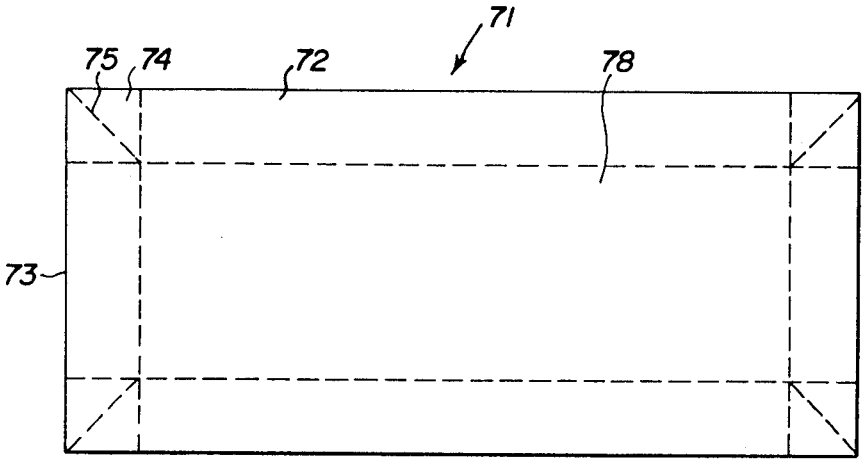
FIG. 12 is a plan view of a blank for use in forming a tray for use with the bag.
Figure 13:
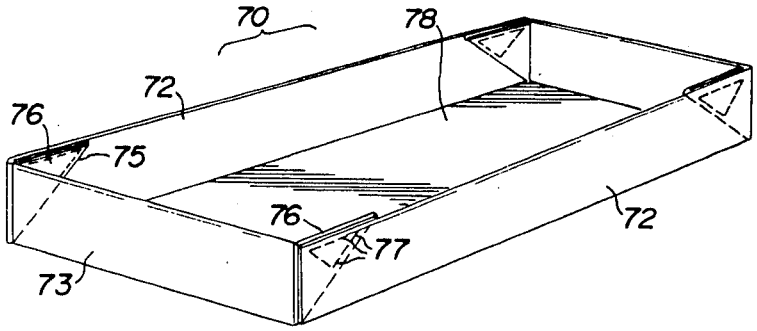
FIG. 13 shows the blank of FIG. 12 erected into a tray.

FIGS. 12 and 13 show the construction of a tray 70 which can be used in conjunction with the bag. This tray 70 is formed from a rectangular blank 71 of similar material to that of the bag, although it can be and usually will be of a much lighter gauge, since it is not called upon to withstand any significant internal pressures or abrasive forces. The material of the blank 71 is folded along the broken lines shown in FIG. 12 to construct the tray of FIG. 13 as follows. As side and end walls 72, 73 are folded upwardly from the central portion 78 which forms the floor portion, a V-shaped flap 76 is formed from each corner portion 74. With the oblique fold line 75 extending inwardly of the tray, each triangular flap 76 is placed against a side wall 72 as shown in FIG. 13. This triangular flap 76 is then secured in place by stitching along three lines 77, such stitching extending through three thicknesses of the material, namely the side wall 72 and the two thicknesses of the corner portion 74 which has now become the triangular flap 76. It is unnecessary to supply these seams with an overlaid heat seal strip, because, even if the stitch lines were able to leak somewhat, they do not extend down more than half-way of the walls of the tray 70. While the tray is designed to collect spillage and to protect the container against soiling or corrosion or any other ill-effects of escaped liquid, such liquid will normally only be present in relatively small amounts and will not be expected to rise above a low level in the tray. However, if preferred these stitch lines 77 can be sealed as in FIG. 7. Normally the tray will be designed to be as cheap to make as possible, since it will be discarded at the destination.

Figure 14:
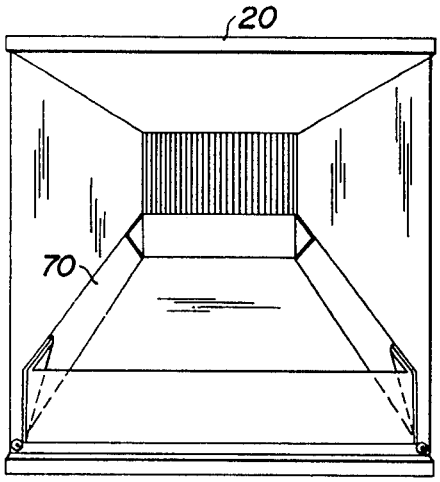
FIG. 14 is an end view of a container with the tray of FIG. 13 located therein.
Figure 15:
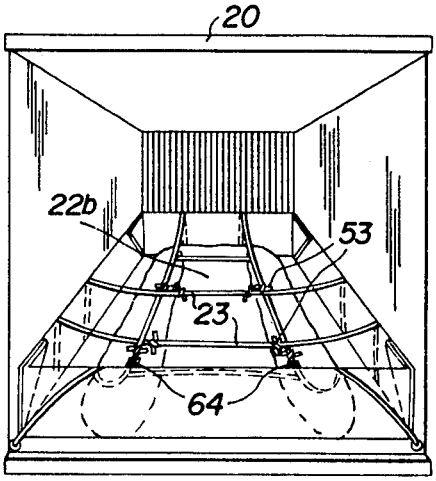
FIG. 15 is a view similar to FIG. 14 but with the bag now arranged inside the tray.
Figure 16:
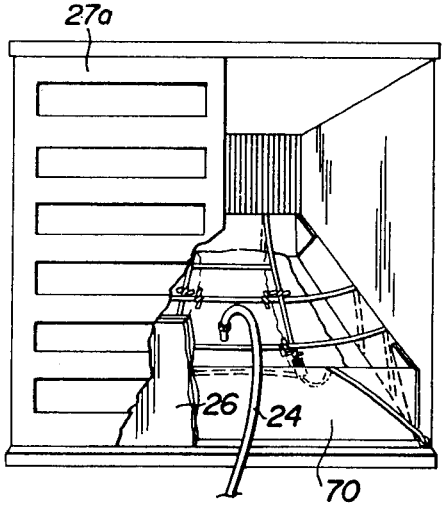
FIG. 16 is a view corresponding to FIG. 15 but showing the commencement of a filling operation.

FIGS. 14 through 17 show the manner of transportation use of the equipment so far described. FIG. 14 shows the container 20 into which the tray 70 has been placed as a preliminary procedure. Then, as shown in FIG. 15, the bag **22*b* , in deflated condition, is placed inside the tray 70 and the harness straps 23 are placed over the bag, threaded through the loops 53 and finally over the walls of the tray to be secured to the standard fixings provided along the sides of the floor of the container. Before the filling procedure can take place, it is a safety requirement that the bulkhead 26 be in place and the door 27*a* be closed, as shown broken away in FIG. 16. Filling then takes place through hose 24 until the final condition of a completely filled container is achieved, as shown in FIG. 17**.

More specific details of this use of the equipment are as follows.

Firstly, the container floor is swept clean, the floor, sides and bulkhead being inspected for any sharp objects that might damage the equipment. Then, as indicated above, the tray is put in place. The bag is then unrolled and placed in the tray. Conveniently there will be appropriate markings on the bag to assist in positioning it correctly.

The bag should lie smoothly on the floor of the tray without any twists or folds. The harness of straps is then placed over the bag and the hooks on the ends of these straps are secured to the corresponding lashing rings provided in the container. Any slack in the straps should be folded inward to prevent being trapped during filling and the buckles should be released. The bulkhead is then put in place and one door closed.

To load the bag with the liquid to be transported, the flexible hose is connected to the filling and emptying valve 50. If a self-sealing coupling is not used, the hose should also include a manually operable valve to minimize spillage. Conveniently, the weight of the hose and the valve can be supported by a length of rope (not shown) attached to the ceiling of the container.

The vent cap **51*a* is then removed and filling is commenced by pumping the liquid through the hose 24. The top surface of the bag will rise with the level of the liquid and the harness will tighten. When it is determined that the correct volume of liquid has been loaded into the bag, the valve 50*e* will be closed and the filling hose disconnected. The two longitudinal straps will then be tightened by means of the buckles 64. The screw cap 51*a* on the vent pipe will be closed. Finally, the second door 27*b*** will be closed and the container sealed.

At the destination, the door **27*b* will be opened but the door 27*a* and the bulkhead 26 will remain in place during unloading. A flexible suction hose will be connected to the filling and emptying valve 50 and a positive suction pump connected to the hose. The air vent 51 must be kept closed while the bag is being discharged so that a partial vacuum will be formed in the bag to cause it to collapse. If the contents of the bag should be particularly viscous, final discharge of residue can be achieved by disconnecting the suction line for a few minutes to allow the contents to run out of the folds, after which pumping out is recommenced. If necessary, any residual contents can be drained through the drain 52**.

The bag can then be slit along the lines 60, 61, as already explained, with the central portion thereof becoming the article 62 for use as a tarpaulin or the like. The end portions of the bag are discarded. The tray will also normally be discarded. The harness system of straps and buckles will normally be reclaimed for repeated use.

Use of the tray 70 is optional. If preferred, the bag can be placed directly on the floor of the container.

I claim:

1. A method of using a bag of tough, flexible sheet material for the one-way transportion of liquid in bulk, said bag being filled tight except for controlled access means for filling and emptying the bag, said bag having a series of spaced-apart tie down means secured to said material, said method comprising (a) mounting the bag in a freight container and thereupon filling it with bulk liquid, (b) transporting the freight container to a desired destination and there emptying the liquid from the bag, and (c) cutting the bag to form a sheet with said tie down means disposed around the periphery thereof to render the same suitable for use as a tarpaulin.

2. A method according to claim 1, wherein said bag has a central, generally cylindrical, elongated portion extending into curved end portions, the tie down means being arranged in a pair of circumferential rows extending around the periphery of the central portion near each end portion and in a further pair of parallel rows adjacent each other and extending longitudinally along the central portion between said circumferential rows, and wherein said cutting step (c) comprises (d) cutting the bag peripherally between the central portion and each end portion adjacent said circumferential rows of tie down means, and (e) cutting the bag longitudinally between said further pair of rows from one peripheral cut to the other to thereby form a substantially rectangular sheet with the tie down means disposed substantially uniformly around its periphery.

* * * * *